US006433757B1

(12) United States Patent
Shrader

(10) Patent No.: US 6,433,757 B1
(45) Date of Patent: Aug. 13, 2002

(54) ANTENNA POLARIZATION ADJUSTMENT TOOL

(75) Inventor: Arthur J. Shrader, Dallas, TX (US)

(73) Assignee: WorldCom, Inc., Clinton, MS (US)

( * ) Notice: Subject to any disclaimer, the term of this patent is extended or adjusted under 35 U.S.C. 154(b) by 0 days.

(21) Appl. No.: 09/742,021

(22) Filed: Dec. 20, 2000

Related U.S. Application Data

(60) Provisional application No. 60/219,466, filed on Jul. 20, 2000.

(51) Int. Cl.[7] ..... H01Q 15/20
(52) U.S. Cl. ..... 343/915; 343/912
(58) Field of Search ..... 343/840, 912, 343/915, 882; H01Q 15/14, 15/20

(56) References Cited

U.S. PATENT DOCUMENTS 4,647,943 A * 3/1987 Metcalfe ..... 343/916
4,683,475 A * 7/1987 Luly ..... 343/915
5,446,474 A * 8/1995 Wade et al. ..... 343/915
5,488,383 A * 1/1996 Friedman et al. ..... 343/912
5,773,108 A * 6/1998 Casebolt ..... 428/36.1

OTHER PUBLICATIONS

U.S. application No. 60/219,466, Arthur J. Schrader.

* cited by examiner

*Primary Examiner*—Tho Phan

(57) ABSTRACT

For use upon a high-frequency communications antenna comprising a reflector and a feed waveguide, a tool is provided to facilitate adjustment of polarization alignment by rotating the feed waveguide within the antenna. The tool engages a feed hub coupled to the feed waveguide provides a readily accessible lever arm to facilitate rotating the feed hub. Use of the tool allows fine adjustment of polarization alignment and reduces the incidence of damage and impairments that occur when other feed system components are improperly used to apply torque.

20 Claims, 2 Drawing Sheets

ANTENNA POLARIZATION ADJUSTMENT TOOL

CROSS REFERENCES TO RELATED APPLICATIONS

The present application is related to the following co-pending U.S. patent application: U.S. patent application entitled, "Antenna Polarization Adjustment Tool", having application No. 60/219,466, and filed on Jul. 20, 2000, currently pending;

which are assigned to the assignee of the present invention.

FIELD OF THE INVENTION

The present invention is related to telecommunications antennas and, in particular, to alignment of microwave reflector antennas.

BACKGROUND

Microwave antennas for line-of-sight terrestrial communications and earth station satellite communications often use large curved reflectors and are sometimes referred to as "dish" antennas. The reflector comprises a metal material to reflect radio waves. For receiving signals, the large reflector is used to collect and focus electromagnetic waves into a receiver to obtain a stronger signal at the receiver. For transmitting, this type of antenna has a highly directional characteristic, resulting in efficient transmission of signals to a distant target.

FIG. 1 shows a typical antenna 100 comprising a main reflector 110. Antenna 100 depicted in FIG. 1 uses a particular arrangement of reflectors known as Gregorian optics. A typical commercially available antenna of this type is the 3.7 -meter earth station antenna which is available from Andrew Corporation 10500 W. 153rd St. Orland Park, Ill. 60462. In accordance with this arrangement, a subreflector 120 is suspended in front of the main reflector 110 by several struts 122 running from the main reflector 110 to subreflector 120. Subreflector 120 is substantially aligned with the axis of symmetry of main reflector 110. Protruding from main reflector 110 along the axis of symmetry and into the focal point of the reflector assembly is the so-called "feed horn" 130. Feed horn 130 is a hollow waveguide through which radio signals at the antenna are coupled to electronic instruments such as receivers and transmitters. Feed horn 130 may conduct signals from a microwave transmitter coupled to antenna 100. The signals from the transmitter (not shown) are emitted from feed horn 130, strike subreflector 120, and then are reflected back to main reflector 110. From there, the signals are sent forth from antenna 100 to reach a distant target. Conversely, for receiving, the signals from a remote target strike main reflector 110, are collected and focused upon subreflector 120, the curvature of which causes the signals to become somewhat more focused and to be coupled into antenna feed horn 130.

Alignment of such an antenna is important to its performance because of the high degree of directionality of the antenna and the distances typically traversed by a radio signal, which may range from 10–30 miles in the case of terrestrial links to around 22,300 miles in the case of a satellite in geosynchronous orbit. At these distances, even a slight angular misalignment can cause loss of signal path. Misalignment or distortion in the shape of the antenna can also cause both received and transmitted signals to be weakened. At microwave frequencies, even slight distortions in the antenna or the waveguides used to coupled signals to and from the antenna can seriously affect signal quality. Sufficient distortions in the shape of the antenna can cause more complex forms of signal impairments, affecting frequency response and phase relationships.

Another aspect of antenna alignment relates to the polarization of the signal, referring to the orientation of the electric and magnetic components of the signal as it propagates. In order to successfully transmit a signal from one antenna to another, the receiver must be receptive to the same polarization emitted by the transmitter. Otherwise, even though the transmitting antenna may be directed to transmit signals at the receiving antenna, the signal may not be received if the transmitted signal is polarized in a substantially vertical direction while the receiver is receptive to signals that are polarized in a relatively horizontal direction. A corresponding receiver and transmitter must be aligned in terms of polarization.

Generally, adjustments are provided in the mounting of the antenna to allow coarse and fine positioning of the entire antenna assembly to point at a desired target. Furthermore, the orientation of the polarization for received or transmitted electromagnetic waves may be altered by rotating the feed horn, along with the associated waveguide couplers and such attached to the back end of the feed horn. Generally a feed horn assembly can be rotated within a reflector assembly. In one common arrangement, the base of the feed horn, the "feed hub" is circular and concentrically nested into the so-called "vertex opening" at the center of the reflector. Once the feed horn assembly has been rotated to an optimum position, clamping fasteners around the perimeter of the feed hub are tightened to secure the feed horn assembly to the reflector.

For example, FIG. 1 shows a mounting ring 112 attached to reflector 110 such that mounting ring 112 surrounds the vertex opening at the back of reflector 110. Feed hub 132 is concentric with, and seated within, mounting ring 112. Feed hub 132 rigidly supports feed horn 130 and rotation of feed hub 132 accomplishes rotation of feed horn 130. Feed hub 132 comprises a number of fastener positions 136 and 137 where clamping fasteners may be placed to secure feed hub 132 in place within mounting ring 112.

In attempting to rotate the feed horn during polarization alignment, service personnel have difficulty finding a suitable place to apply torque to rotate the feed hub because feed hub 132 tends to bind with mounting ring 112. In many cases, tubular extension 134 is provided that protrudes behind the feed hub and is concentric with the feed tube. The manufacture of antenna intended that tubular extension of the antenna, be gripped by operational personal and used to rotate feed horn 130. However, tubular extension 134 is usually so short that for only one hand to adequately engage the tube. Furthermore, tubular extension 134 is of small diameter, increasing the difficulty with which service personnel can grip and apply torque to precisely rotate the feed horn assembly.

Often, in lieu of using this torque tube extension, service personnel will use other attachments to feed horn 130 to more easily apply torque. Although not shown in FIG. 1, waveguide couplers/combiners and electronic units, such as receiver front-ends, may be attached behind extension 134. When antenna 100 is configured with waveguide couplers/combiners and electronic units, feed hub 132 tends to bind even further with mounting ring 112, due to the cantilever affect from the weight of to waveguide and electronic units on the interfacing surfaces of feed hub 132 and mounting ring 112. The waveguide and/or electronics equipment presents a technician with a more prominent handhold for torqueing the feed tube assembly. However, applying torque to these sensitive components is risky and can result in the distorting or inadvertent breaking of waveguide feed components, potentially degrading or interrupting communications. Such damage can be extremely costly to repair. Moreover, some types of damage may be subtle enough to cause latent problems which are difficult and expensive to troubleshoot at a later time.

Thus, there is a need for an improved method by which a technician may easily and precisely align the polarization of the microwave antenna without exerting forces upon sensitive parts of the feed system.

The present invention provides for an improved method by which a feed system may be rotated within an antenna to facilitate the adjustment of polarization. The present invention provides for a novel polarization adjustment tool that engages the feed hub nested within the main reflector mounting ring. A technician using such a device may exert a torque directly to the feed hub without applying forces to other more delicate parts of the feed system.

In accordance with an exemplary embodiment, long lever arm is provided by the tool so that a technician may apply torqueing forces with less effort applied at the handle. The long lever arm improves the accessibility of the adjustment and dramatically improves the precision with which the feed assembly may be manually adjusted. The tool provided by the present invention offers these advantages over the prior art practice of using only a one-handed grip applied to the small torque tube behind the feed hub.

In accordance with an exemplary method of use, some of the points along the feed hub where fasteners are used to claim the feed hub to the mounting ring are also used as points where the adjustment tool engages the feed hub. In accordance with an exemplary embodiment of the present invention, the tool comprises at least two holes through which fasteners may be applied to attach the tool to the feed hub using the existing fasteners. Therefore, in accordance with an exemplary embodiment of the present invention, the holes in the tool are positioned so as to align with the positions of fasteners on the feed hub. In this manner, existing bolt holes or studs may be used to simply mount the tool atop the existing clamping hardware.

In accordance with an exemplary embodiment, the polarization adjustment tool is bifurcated at one end in order to straddle the central portion of the feed hub and to engage pairs of fasteners that are not adjacent along the edge of the feed hub. As will be described later, this aspect is useful where clamping fasteners and non-clamping fasteners are interspersed on the feed hub.

In accordance with an exemplary embodiment, the polarization adjustment tool comprises at least one offset portion which provides for clearance behind the feed hub. The clearance ensures that the tool does not interfere with the mounting ring and fasteners and especially allows access so that clamping fasteners "under" the tool are accessible for loosening and tightening during the adjustment procedure.

BRIEF DESCRIPTION OF THE DRAWINGS

Further features and advantages of the present invention will become evident by reading the following detailed description in conjunction with the accompanying drawings wherein.

DETAILED DESCRIPTION OF EXEMPLARY EMBODIMENT

The present invention is directed to a tool used to facilitate polarization adjustments by providing improved access and leverage to rotate the feed assembly in an antenna. Referring back to FIG. 1, a polarization adjustment tool 200 is shown relative to antenna 100 to depict how the tool would be applied to an antenna in accordance with an exemplary embodiment of the present invention. Tool 200 may be retrofitted to existing antenna installations or may be provided as a standard part for new installations.

Figure 1:
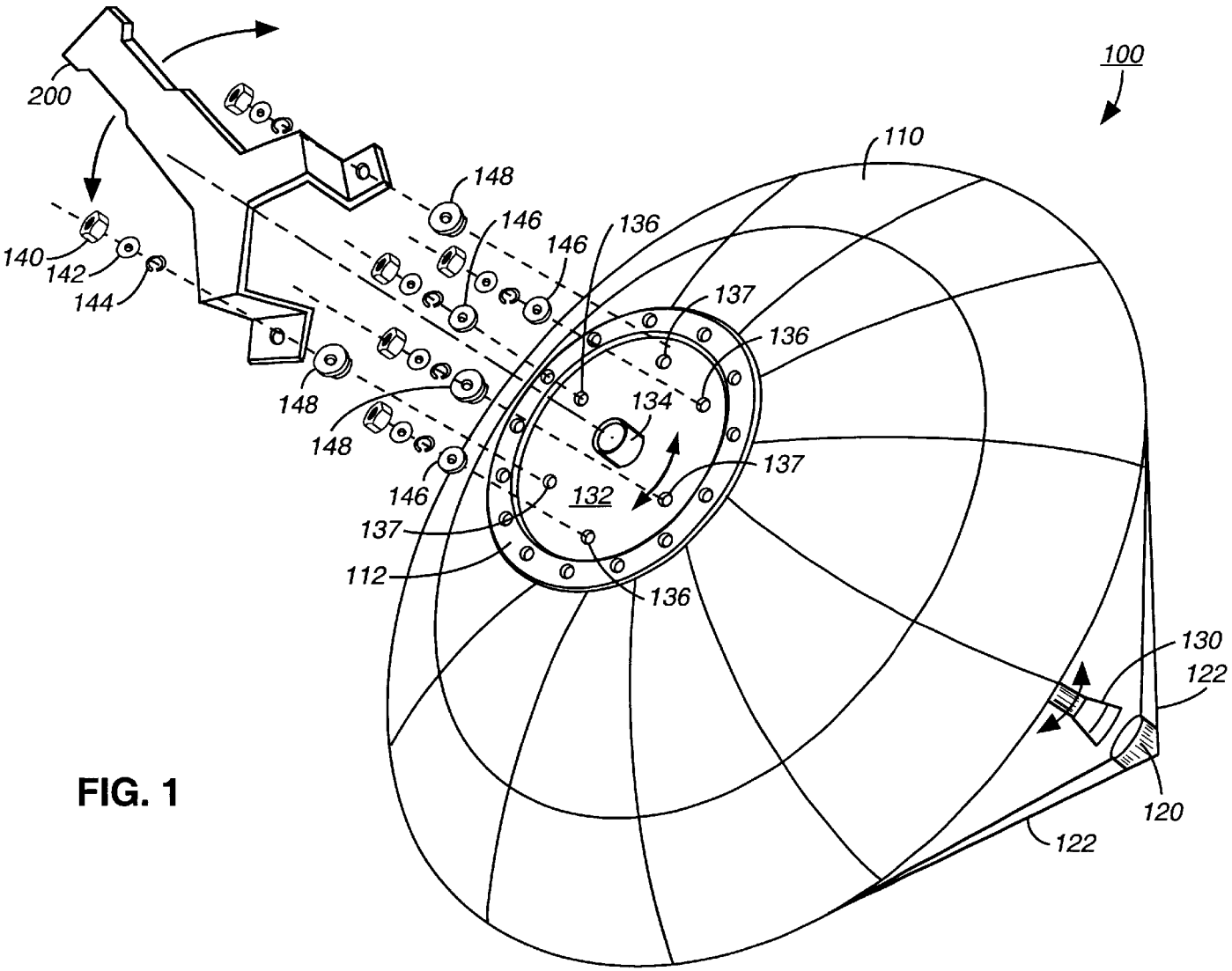
FIG. 1 is a pictorial showing a typical reflector antenna and the application of a polarization adjustment tool thereto in accordance with an exemplary embodiment of the present invention.

In FIG. 1, feed hub 132 is shown to comprise clamping fastener positions 136 and non-clamping fastener positions 137. Each fastener position may be, for example, a bolt hole or a stud for accepting fasteners. Commonly, six fastener positions are employed on the feed hub as shown in FIG. 1, but any number of fasteners may actually be employed. At three of the positions, the fasteners tighten the feed hub to the mounting ring and prevent rotation during the normal use of the antenna. During polarization alignment, these three fasteners are loosened to permit adjustment of the feed hub. At the remaining three positions, the fasteners are firmly attached to the feed hub but provide a slight clearance so that the feed hub may rotate within the mounting ring. These non-clamping fasteners are sufficient to hold the feed assembly in coaxial alignment with the reflector portions of the antenna assembly, but are loose enough to allow rotation of the feed hub.

Thus, in FIG. 1, clamping fastener positions 136 are shown to each to be supplied with a large flat washer 146, a lock washer at each position 136, these parts are intended to mate with a threaded member (not shown) protruding through feed hub 132. In contrast, the non-clamping fastener positions 137 are each provided with a shoulder washer 148 along with a lock washer 144, a flat washer 142, and a nut 140. Shoulder washer 148 provides a standoff so that feed hub 132 is held only loosely within mounting ring 112.

As shown in FIG. 1, clamping fastener positions 136 are interspersed with the non-clamping fastener positions 137 along feed hub 132. Normally, in performing a polarization adjustment, the clamping fasteners are loosened and the feed hub may be rotated with the non-clamping fasteners keep the feed hub nested in the mounting ring and aligned with the reflectors. When the polarization adjustment is complete, the clamping fasteners are again tightened.

With this arrangement of fasteners on feed hub 132, polarization adjustment tool 200 is shown to attach to feed hub 132 at two non-clamping fastener positions 137. As shown, portions of tool 200 are simply attached atop shoulder washers 148 using the existing hardware. Once attached, the tool may remain in place because the non-clamping fasteners need not be loosened during polarization alignment. Those of ordinary skill in the art will recognize that the tool may be left permanently attached to the feed hub or may be detached after use. Furthermore, while FIG. 1 depicts that tool 200 becomes affixed to feed hub 132, those of ordinary skill in the art will appreciate that tool 200 may be used in such a way or fashioned in such a way that contact between tool 200 and feed hub 132 is momentary and accomplished manually each time the feed hub needs to be rotated. For example, if threaded fasteners or nuts or bolt heads used at positions 136 and 137 protrude sufficiently behind feed hub 132, then tool 200 may be fashioned to bear against, wedge onto or underneath, or otherwise engage the fasteners or other features without itself becoming rigidly attached to feed hub 132. The arrangement of the tool onto the feed hub depicted in FIG. 1 is intended to be merely exemplary and not limiting to the variations encompassed by the present invention. In accordance with an exemplary embodiment, tool 200 is provided with holes and attached to feed hub 132 as shown in FIG. 1 so that tool 200 becomes permanently attached to antenna 100. Tool 200 may be made at such low cost that it is practical to leave the tool installed permanently.

Figures 2, 3:
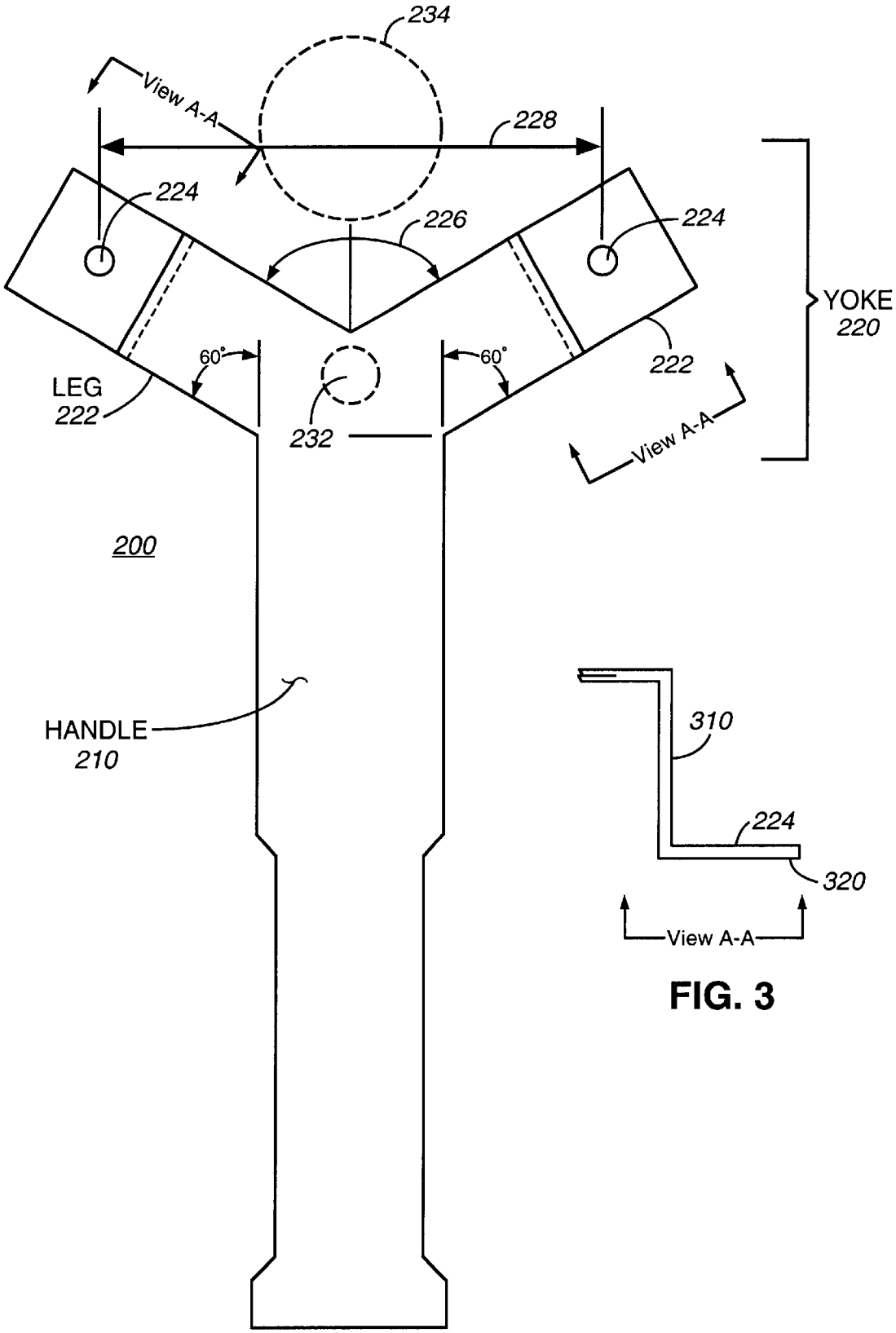
FIG. 2 is a diagram of a polarization adjustment tool in accordance with a exemplary embodiment of the present invention.
FIG. 3 is a diagram depicting a detailed portion of the legs of a polarization tool in accordance with an exemplary embodiment of the present invention.

Referring now to FIG. 2 of the accompanying drawings, a detailed diagram of polarization adjustment tool 200 is shown in accordance with an exemplary embodiment of the present invention. In FIG. 2, polarization adjustment tool 200, also referred to as a "polarization adjustment wrench", is shown to comprise a single piece of material, which is preferably a sheet of eighth-inch thick aluminum that has been formed by stamping, machining or bending into the shape depicted in FIG. 2.

Tool 200 is shown to comprise an elongated handle 210, which may be around 10 inches in length. To facilitate gripping tool 200, some contouring of the handle may be done as shown pictorially in FIG. 2.

In accordance with an exemplary embodiment, tool 200 is shown to comprise a bifurcated end, or a yoke 220 forming two legs 222 integrated with handle 210. Each leg 222 comprises an engaging point distal to the handle where the tool is intended to engage the fastener features on the feed hub. In FIG. 2, the engaging points are holes 224 through which fasteners on the feed hub may pass through tool 200. The distance 228 between holes 224 is selected to match the distance between corresponding fasteners on feed hub 132. The legs 222 are preferably separated by an included angle 226 of 120 degrees. The combination of distance 228 and angle 226 creates an open space between legs 222 so that tool 200 does not interfere with feed tub 134 and other parts of the feed assembly. Feed tube outline 234 is shown in FIG. 2 to depict approximately where the feed tube will pass between legs 222.

Note that, because clamping and non-clamping fasteners are interspersed in the feed hub, the distance 228 corresponds to two fastener intervals and that another fastener, a clamping fastener, will be occluded by the yoke portion 220 of tool 200. The position of the occluded fastener is depicted by superimposed location 232. Because the polarization adjustment requires access to the occluded fastener, tool 200 should not rest upon the occluded fastener.

Therefore, turning now to FIG. 3 as a side view of a leg 222, each leg 222 comprises an offset portion 310 so that the yoke and handle of tool 200 are displaced further behind the feed hub than the fasteners and so that clearance is provided for a user of the tool to be able to access the occluded fastener. Leg 222 in FIG. 3 is shown to comprise a foot section 320 that is one and a half inches in length in accordance with an exemplary embodiment of the present invention. Furthermore, FIG. 3 shows an offset portion 310 having a dimension of two inches in accordance with an exemplary embodiment and being formed by two 90 degree bends in the material that makes up tool 200. It is a benefit to the rigidity of the tool and the ease of its manufacture that the bend offset portions of 310 of each leg 222 are nearly orthongonal to one another given the angle between the legs. While particular dimensions are shown in FIG. 2 by way of instruction, those of ordinary skill in the art will recognize that these dimensions and choice of materials and manufacturing techniques described above are merely exemplary and that other variations may be used to be applied for the same purpose in accordance with the present invention without departing from the spirit and scope of the invention.

In accordance with an alternative embodiment, tool 200 may comprise a handle with one or more engaging points at either end of the handle. For example, tool 200 may comprise a handle formed as a loop with each end being attached to or engaging a non-clamping fastener on the feed hub.

In accordance with another exemplary embodiment, tool 200 may be used to accomplish polarization adjustments on antennas other than those of similar design to antenna 100. For instance, although no shown in the accompanying figures, the antenna design may be such that the reflector and feed horn assembly form an integral assembly in which the feed horn assembly is not free to rotate within a mounting ring. In such an antenna design, polarization is accomplished by rotating the entire reflector and feed horn assembly on a locking axial hub which is coaxial with the feed horn. Such a design exhibits similar shortcomings as those described above with respect to antenna 100 above, but have the further disadvantage of present a technician with an additional convenient handhold, the reflector itself. Here, because the reflector rotates in unison with the feed horn, a technician may become tempted to use the outer diameter of the reflector as a polarization adjustment lever. While a rigidly constructed reflector may temporally tolerate such abuse without any immediate signal degradation, continued polarization adjustments may flex the reflector and permanently wrap the reflecting surface of the reflector, thus diminishing its reflecting properties. A less rigidly constructed antenna, such as a wire mesh or fabric antenna, might suffer a significant and permanent diminution of its reflecting capabilities on the first polarization adjustment. Thus, tool 200 may be employed in the manner described above to facilitate adjustment of polarization alignment by rotating the feed waveguide with the antenna's reflector.

While the present invention is subject to many variations, modifications, and changes in detail, it is intended that all matters described in this specification and shown in the accompanying drawings be interpreted as illustrative only and not in a limiting sense. Accordingly, it is intended that the invention be limited only the spirit and scope of the claims appended hereto.

What is claimed is:

1. For an antenna having a feed assembly rotatably coupled to a reflector assembly, a tool for rotating the feed assembly relative to the reflector assembly comprising:

an elongated handle whereby a user may grasp the handle and apply torque to the feed assembly;

at least two engaging points rigidly coupled to the handle, each engaging point being designed to mechanically couple to the feed assembly at a position where a fastener is used to secure the feed assembly to the reflector assembly, whereby the tool applies forces to the feed assembly.

2. The tool of claim 1 wherein one end of the handle is branched into two or more legs and an engaging point is disposed substantially near the end of each leg distal from an unbranched end of the handle.

3. The tool of claim 2 wherein each leg comprises an offset portion which causes a plane of the handle to be offset from a plane of the engaging points, said planes being normal to the axis of rotation of the feed assembly.

4. The tool of claim 2 wherein the handle comprises an offset portion which causes a plane of the handle to be offset from a plane of the engaging points, said planes being normal to the axis of rotation of the feed assembly.

5. The tool of claim 1 wherein the handle further comprises a yoke portion where the handle is bifurcated into two legs and an engaging point is disposed substantially near an end of each leg distal from an unbranched end of the handle.

6. The tool of claim 5 wherein the two legs are separated by an angle whereby an opening is formed between the engaging points, the opening being sufficiently large to allow a portion of the feed assembly to pass between the engaging points.

7. The tool of claim 1 wherein at least one engaging point is disposed at either end of the handle.

8. For an antenna having a feed assembly and reflector assembly rotatably coupled to a mounting assembly, a tool for rotating the feed assembly relative to the mounting assembly comprising:

an elongated handle whereby a user may grasp the handle and apply torque to the feed assembly;

at least two engaging points rigidly coupled to the handle, each engaging point being designed to mechanically couple to the antenna at a position where a fastener is used to secure the feed assembly to the mounting assembly, whereby the tool applies forces to the feed assembly.

9. The tool of claim 8 wherein one end of the handle is branched into two or more legs and an engaging point is disposed substantially near the end of each leg distal from an unbranched end of the handle.

10. An polarization system for an antenna comprising:

a reflector assembly;

a feed assembly;

a rotatably coupling for rotatably securing said feed assembly to the reflector assembly; and a tool for rotating the feed assembly relative to the reflector assembly comprising:

an elongated handle;

at least two engaging points rigidly coupled to the handle; and at least two coupling means, wherein each coupling means mechanically couples an engaging point of said tool to the feed assembly at a position where the rotatably coupling rotatably secures said feed assembly to the reflector assembly, whereby force applied to said elongated handle translates to torque on the feed assembly and thereby alters the polarization for the antenna.

11. The polarization system of claim 10, wherein the tool further comprises:

two or more legs branched from said handle, wherein an engaging point is disposed substantially near an end of each leg distal from an unbranched end of the handle.

12. The polarization system of claim 11, wherein each leg of the tool further comprises:

an offset portion forming a first plane of the two or more legs having engaging points to be offset from a second plane of the handle, wherein said first and second planes being normal to the axis of rotation of the feed assembly.

13. The polarization system of claim 11, wherein the handle of the tool further comprises:

an offset portion forming a first plane of the handle to be offset from a second plane of the two or more legs having engaging points, wherein said first and second planes being normal to the axis of rotation of the feed assembly.

14. The polarization system of claim 10, wherein the handle of the tool further comprises:

a yoke portion being formed from the handle being bifurcated into two legs, wherein an engaging point is disposed substantially near an end of each leg distal from an unbifurcated end of the handle.

15. The polarization system of claim 14, wherein the two legs on the yoke portion of the tool are separated by an angle sufficiently large that a resultant distance formed between the two legs at the engaging points is sufficiently large to allow a portion of the feed assembly to pass between the engaging points.

16. The polarization system of claim 10, wherein at least one engaging point is disposed at either end of the handle of said tool.

17. A tool for adjusting the polarization of antenna by cooperating with a feed assembly rotatably coupled to a reflector assembly, the tool comprising:

an elongated handle portion; and at least two feed assembly engaging points disposed on said tool, each feed assembly engaging point being configured to align with and mechanically couple to one of a plurality of fasteners disposed about the feed assembly, whereby force applied to said handle translates to torque on the feed assembly and thereby alters the polarization for the antenna without alter the position or orientation of said reflector assembly.

18. The tool of claim 17, tool further comprises:

two or more leg portions joined to an end of said handle portion, wherein an engaging point is disposed substantially near a distal end of each leg portion.

19. The tool of claim 18, further comprises:

a first plane defined by said handle portion; and a second plane defined by said leg portions, wherein said second plane being offset from said first plane by a predetermined distance.

20. The tool of claim 17, wherein the handle portion further comprises:

a yoke portion being formed from the handle being bifurcated into two legs, wherein an engaging point is disposed substantially near an end of each leg distal from an unbifurcated end of the handle.

* * * * *